US007204916B2

(12) United States Patent
Mizohata

(10) Patent No.: US 7,204,916 B2
(45) Date of Patent: Apr. 17, 2007

(54) PLATING APPARATUS AND PLATING METHOD

(75) Inventor: Yasuhiro Mizohata, Kyoto (JP)

(73) Assignee: Dainippon Screen Mfg. Co., Ltd. (JP)

( * ) Notice: Subject to any disclaimer, the term of this patent is extended or adjusted under 35 U.S.C. 154(b) by 418 days.

(21) Appl. No.: 10/639,898

(22) Filed: Aug. 12, 2003

(65) Prior Publication Data

US 2004/0055890 A1 Mar. 25, 2004

(30) Foreign Application Priority Data

Aug. 29, 2002 (JP) ..... 2002-251311

(51) Int. Cl.
*C25D 17/02* (2006.01)
*C25D 7/12* (2006.01)

(52) U.S. Cl. ..... 204/230.2

(58) Field of Classification Search ..... None
See application file for complete search history.

(56) References Cited

U.S. PATENT DOCUMENTS

| | | | | |
|---|---|---|---|---|
| 6,132,587 | A | 10/2000 | Jorne et al. | 205/123 |
| 6,365,017 | B1 | 4/2002 | Hongo et al. | |
| 2001/0040100 | A1 * | 11/2001 | Wang | 205/220 |
| 2002/0020627 | A1 | 2/2002 | Kunisawa et al. | |

FOREIGN PATENT DOCUMENTS

| | | | |
|---|---|---|---|
| JP | 04-311591 | A * | 11/1992 |
| JP | 2002-031145 | | 1/2000 |
| JP | 2000-87299 | | 3/2000 |
| JP | 2001-316887 | | 11/2001 |
| JP | 2002-4091 | | 1/2002 |
| JP | 2002-004091 | | 1/2002 |
| JP | 2002-503766 | | 2/2002 |
| JP | 2002-235188 | | 8/2002 |
| WO | WO 99/41434 | | 8/1999 |

* cited by examiner

*Primary Examiner*—Harry D. Wilkins, III
(74) *Attorney, Agent, or Firm*—Ostrolenk, Faber, Gerb & Soffen, LLP

(57) ABSTRACT

A plating apparatus for performing a plating process for plating a surface of a substrate. This plating apparatus is provided with a first electrode to be brought into contact with a peripheral edge portion of the substrate; a plating vessel for containing a plating liquid to be brought into contact with the surface of the substrate, the plating vessel having a vertical tubular interior surface; a second electrode disposed in the plating vessel, the second electrode being spaced from the substrate by a distance which is not smaller than a distance between a center portion and a peripheral edge portion of the substrate during the plating process; and an electric current limiting member for limiting horizontal flow of an electric current in the plating liquid between the second electrode and the substrate within the plating vessel during the plating process.

9 Claims, 3 Drawing Sheets

PLATING APPARATUS AND PLATING METHOD

BACKGROUND OF THE INVENTION

1. Field of the Invention

The present invention relates to a plating apparatus and a plating method for performing a plating process with a surface of a substrate such as a semiconductor substrate kept in contact with a plating liquid.

2. Description of Related Art

FIG. 4 is a schematic sectional view of a conventional plating apparatus. In FIG. 4, an electrical equivalent circuit is also shown.

The plating apparatus is adapted to perform a plating process for plating one surface of a generally round semiconductor substrate (hereinafter referred to as "wafer") W, and includes a plating vessel 51 for containing a plating liquid, and a holder 52 for horizontally holding the wafer W.

The plating vessel 51 has a cylindrical interior surface having an inner diameter greater than the diameter of the wafer W. A disk-shaped anode 53 is horizontally disposed in the plating vessel 51 in the vicinity of the bottom of the plating vessel 51. The anode 53 has a diameter smaller than the diameter of the wafer W. The holder 52 has a ring shape as seen in plan, and is adapted to support a peripheral edge portion of the wafer W to horizontally hold the wafer W. A plurality of cathodes (not shown) are provided in the holder 52. These cathodes are brought into contact with a peripheral edge portion of a lower surface of the wafer W at positions circumferentially spaced at predetermined intervals.

The cathodes provided in the holder 52 and the anode 53 are connected to a DC power source 54. A copper seed layer is formed on the surface of the wafer W.

When the plating process is to be performed on the wafer W, the plating liquid containing copper ions is first filled in the plating vessel 51, and the wafer W is generally horizontally held by the holder 52 with the seed layer thereof facing downward. Then, the lower surface of the wafer W is brought into contact with the surface of the plating liquid filled in the plating vessel 51, and a DC voltage is applied between the anode 53 and the cathodes provided in the holder 52 by the DC power source 54. At this time, the center of the anode 53 and the center of the wafer W are generally aligned along a common vertical line. Thus, electrons are donated to copper ions in the plating liquid from the lower surface of the wafer W, so that copper atoms are deposited on the lower surface of the wafer W. In this manner, the lower surface of the wafer W is electrolytically plated.

In the plating process described above, the plating liquid is regarded, from an electrical viewpoint, as being constituted by a multiplicity of resistance components each having a resistance rc and horizontally and vertically connected to one another in a network as shown in FIG. 4. Further, the seed layer is regarded as being constituted by a plurality of resistance components each having a resistance rs and serially connected to one another between the center portion and the peripheral edge portion of the wafer.

The electric current is more liable to flow through a path having a smaller resistance between the anode 53 and the cathodes. A comparison is herein made between the resistance of an electric current path (hereinafter referred to as "first path") extending from the center portion of the anode 53 vertically through the plating liquid to the center portion of the lower surface of the wafer W and then to the cathodes kept in contact with the peripheral edge portion of the wafer W and the resistance of an electric current path (hereinafter referred to as "second path") extending from the peripheral edge portion of the anode 53 vertically through the plating liquid to the peripheral edge portion of the wafer W and then to the cathodes kept in contact with the peripheral edge portion of the wafer W. It is herein assumed that the plating liquid has a resistance Rc as measured vertically, and the seed layer has a resistance Rs as measured between the center portion and the peripheral edge portion of the wafer W.

In this case, the resistance of the first path is nearly equal to Rc+Rs. The resistance of the second path is nearly equal to Rc, because the electric current does not flow through the seed layer.

Since the seed layer has a small thickness, the resistance of the seed layer is not negligible. Particularly, where a minute pattern is to be formed on the wafer W, the seed layer has a very small thickness (e.g., 50 to 100 nm). Therefore, the resistances rs and Rs are increased. That is, the resistance of the first path is increased as compared with the resistance of the second path thereby to adversely influence the plating process.

Therefore, the electric current is less liable to flow through the center portion of the wafer W, and more liable to flow through the second path. In the electrolytic plating, the thickness of a film formed by the plating (plating thickness) is generally proportional to the amount of the electric current flowing from the plating liquid to the substrate. Therefore, the plating thickness is relatively small in the center portion of the wafer W and relatively thick in the peripheral edge portion of the wafer W.

In order to alleviate the non-uniformity of the plating thickness, the vertical resistance Rc of the plating liquid is increased by increasing the depth of the plating vessel 51 (a distance between the anode 53 and the wafer W) in the conventional plating apparatus. This supposedly reduces a difference in plating thickness between the center portion and the peripheral edge portion of the wafer W.

In practice, however, the electric current also flows horizontally through the plating liquid, so that the amount of the electric current flowing through the center portion of the wafer W is smaller than that calculated in consideration of the vertical resistance of the plating liquid alone. The resistance of the plating liquid as measured horizontally is regarded as the total resistance of a multiplicity of horizontal resistance components arranged depthwise of the plating vessel and connected in parallel.

As the depth of the plating vessel 51 is increased, the number of horizontal resistance components connected in parallel is increased, thereby reducing the horizontal resistance of the plating liquid. That is, the electric current is more liable to flow horizontally through the plating liquid, as the depth of the plating vessel 51 is increased. As a result, a greater amount of electric current bypasses the seed layer having a higher resistance to reach the peripheral edge portion of the wafer W.

For example, it is herein assumed that the plating liquid has a resistivity rc of 2 Ωcm and the plating vessel 51 has a depth of 20 cm. Where the plating liquid is regarded as an aggregate of liquid columns each having a 1-cm square section, the resistance rc/L of each of the liquid columns as measured laterally (horizontally) is 0.1Ω. This resistance level is virtually equivalent to the sheet resistance of the seed layer having a thickness of 100 nm. That is, the amount of the electric current flowing laterally through the plating liquid is nearly equal to the amount of the electric current flowing through the seed layer.

Where the inner diameter of the plating vessel 51 is greater than the outer size of the wafer W, an electric current flow path is established in the vicinity of the interior surface of the plating vessel 51. Therefore, the amount of the electric current flowing through the second path is further increased.

For these reasons, the difference in plating thickness between the center portion and the peripheral edge portion of the wafer W cannot be reduced to smaller than a certain level.

SUMMARY OF THE INVENTION

It is an object of the present invention to provide a plating apparatus which can provide a film having a highly uniform thickness by plating.

It is another object of the present invention to provide a plating method which can provide a film having a highly uniform thickness by plating.

The plating apparatus according to the present invention is adapted to perform a plating process for plating a surface of a substrate. The plating apparatus comprises: a first electrode to be brought into contact with a peripheral edge portion of the substrate; a plating vessel for containing a plating liquid to be brought into contact with the surface of the substrate, the plating vessel having a vertical tubular interior surface; a second electrode disposed in the plating vessel, the second electrode being spaced from the substrate by a distance which is not smaller than a distance between a center portion and a peripheral edge portion of the substrate during the plating process; and an electric current limiting member for limiting horizontal flow of an electric current in the plating liquid between the second electrode and the substrate within the plating vessel during the plating process.

According to the present invention, the plating liquid is filled in the plating vessel, and the substrate is brought into contact with the surface of the plating liquid. In this state, the lower surface of the substrate kept in contact with the plating liquid can be plated by energizing the first and second electrodes. At this time, the electric current limiting member limits the horizontal flow of an electric current in the plating liquid between the second electrode and the substrate within the plating vessel during the plating process.

The distance between the second electrode and the substrate in the plating process is not smaller than the distance between the center portion and the peripheral edge portion of the substrate, so that the resistance of the plating liquid as measured vertically is sufficiently great. Therefore, a resistance between the center portion and the peripheral edge portion of the substrate is relatively small. Hence, a difference between the resistance of an electric current path extending from the plating liquid to the first electrode kept in contact with the peripheral edge portion of the substrate via the center portion of the substrate and the resistance of an electric current path extending from the plating liquid to the first electrode via the peripheral edge portion of the substrate is sufficiently small as compared with the resistances of the respective electric current paths.

In this case, the electric current flowing from the center portion of the second electrode (present below the center portion of the substrate) to the plating liquid is forcibly directed upward by the electric current limiting member to reach the center portion of the substrate. Therefore, the amount of the electric current flowing through the electric current path extending through the center portion of the substrate is nearly equal to the amount of the electric current flowing through the electric current path extending through an interface between the plating liquid and the peripheral edge portion of the substrate, so that a generally uniform plating thickness can be provided.

During the plating process, the substrate is kept in contact with the plating liquid contained in the plating vessel in the vicinity of an upper edge of the tubular interior surface of the plating vessel. In this case, the upper edge of the tubular interior surface of the plating vessel is preferably configured so that the entire peripheral edge portion of the substrate can be brought into close proximity to the upper edge portion in the plating process. Thus, the substrate can virtually overlap the plating liquid as seen in plan. When the plating process is performed in this state, the electric current is prevented from flowing outwardly of the peripheral edge portion of the substrate as seen in plan. Hence, there is no possibility that a greater amount of electric current flows in the vicinity of the tubular interior surface of the plating vessel.

The electric current limiting member is preferably dimensioned so that little clearance is left between the interior surface of the plating vessel and the electric current limiting member. In this case, there is no possibility that a greater amount of electric current bypasses the electric current limiting member to flow in the vicinity of the interior surface of the plating vessel.

The substrate may be a semiconductor substrate (semiconductor wafer) having a seed layer formed on one surface thereof. The plating liquid may be formulated so as to plate the semiconductor substrate with copper. In this case, the surface of the wafer formed with the seed layer is brought into contact with the plating liquid for the copper plating. Even if a minute copper pattern is to be formed on the wafer and the seed layer has a smaller thickness and a higher resistance, a uniform plating thickness can be provided.

The substrate may be a polygonal substrate, e.g., a rectangular substrate. In this case, the tubular interior surface of the plating vessel may be dimensioned and configured conformally to the polygonal substrate as seen in plan.

The electric current limiting member may be composed of a material having a higher resistivity than the plating liquid, or composed of an insulative material.

The electric current limiting member of the insulative material can efficiently limit the horizontal flow of the electric current in the plating liquid. Thus, a uniform plating thickness can be provided.

The electric current limiting member may have through-holes horizontally densely formed therein and each extending vertically.

When the plating liquid is filled in the plating vessel, the through-holes of the electric current limiting member are filled with the plating liquid. In this state, the lower surface of the substrate is brought into contact with the surface of the plating liquid filled in the plating vessel, and a voltage is applied between the first electrode and the second electrode. Thus, the lower surface of the substrate can be plated.

At this time, the electric current flows in the plating liquid through the through-holes of the electric current limiting member. Where the electric current limiting member is composed of the resistive material, a small amount of electric current flows horizontally out of the through-holes. Where the electric current limiting member is composed of the insulative member, no electric current flows horizontally out of the through-holes. That is, the electric current limiting member suppresses or prevents the horizontal flow of the electric current, so that the electric current mostly flows vertically.

Since the through-holes are horizontally densely arranged (with no clearance), the electric current limiting member has a high void ratio. Therefore, the electric current evenly flows between the second electrode and the substrate during the plating process. The electric current limiting member has, for example, a honeycomb shape.

Since the electric current flows from openings (upper ends of the through-holes) of the electric current limiting member to the substrate, the amount of the electric current flowing toward portions of the substrate opposed to non-opening portions of the electric current limiting member is reduced. Therefore, the electric current limiting member preferably has a higher opening ratio with a portion thereof between each adjacent pair of through-holes having a smaller thickness.

The electric current limiting member may comprise a plurality of tubes vertically disposed as occupying a space defined between the second electrode and the substrate in the plating vessel during the plating process.

The electric current limiting member can easily be prepared by horizontally densely arranging the tubes in the plating vessel. Further, the opening ratio of the electric current limiting member can be increased by employing tubes each having a small wall thickness.

One example of the tube is a drinking straw. Thus, the electric current limiting member can be prepared at a very low cost. Since the straw has a small wall thickness, the void ratio and opening ratio of the electric current limiting member can be increased.

The electric current can horizontally flow through the plating liquid within the through-holes of the electric current limiting member. If the through-holes of the electric current limiting member each have a greater diameter, the electric current horizontally flows a greater distance through the plating liquid. In such a case, an uneven electric current density distribution is provided in the plating liquid, making it impossible to provide a uniform plating thickness in the plating process.

Therefore, the through-holes of the electric current limiting member preferably each have a smaller cross sectional area, e.g., not greater than 10 $cm^2$.

The electric current can freely horizontally flow through the plating liquid in a portion of the plating vessel vertically unoccupied by the electric current limiting member. Where the unoccupied portion vertically extends a greater distance in the plating vessel, the electric current flows horizontally outward in the unoccupied portion. Therefore, the amount of the electric current flowing through the center portion of the substrate is reduced, so that the plating thickness becomes non-uniform.

Therefore, the upper ends of the through-holes are preferably located in the vicinity of the substrate in the plating process. Lower ends of the through-holes are preferably located in the vicinity of the second electrode.

With this arrangement, a space vertically defined between the second electrode and the substrate is mostly occupied by the electric current limiting member. Therefore, little space is left in which the electric current can horizontally flow through the plating liquid. Since the electric current is merely permitted to flow vertically through the plating liquid, the electric current generally uniformly flows between the plating liquid and the lower surface of the substrate. Thus, a uniform plating thickness can be provided.

The inventive plating apparatus may further comprise a substrate rotating mechanism for horizontally holding and rotating the generally round substrate. In this case, the tubular interior surface may be a cylindrical interior surface having an inner diameter which is nearly equal to the diameter of the generally round substrate.

With this arrangement, the generally round substrate can advantageously be plated. Uniform plating of the substrate can be ensured by rotating the substrate.

The second electrode may substantially overlap the electric current limiting member as seen in plan.

If a space above the second electrode is partly unoccupied by the electric current limiting member, the electric current will horizontally flow in the unoccupied space. In the present arrangement, however, the electric current limiting member occupies most of the space above the second electrode, so that the horizontal flow of the electric current is efficiently limited.

The first electrode may be a cathode, and the second electrode may be an insoluble mesh anode which permits the plating liquid to flow therethrough. In this case, the plating vessel may have a plating liquid inlet port provided in the bottom thereof for introducing the plating liquid into the plating vessel. The inventive plating apparatus may further comprise a plating liquid diffusing member for diffusing the plating liquid introduced from the plating liquid inlet port toward the entire lower surface of the second electrode.

Where a plating metal (target metal) is contained in the form of anions in the plating liquid, the plating apparatus having the aforesaid construction employs the first electrode and the second electrode as a cathode and an anode, respectively, to plate the substrate with the metal.

The amount of the electric current flowing through each electric current path extending between the first electrode and the second electrode (electric current density distribution) depends on the flow of the plating liquid as well as on the resistance distribution between the first and second electrodes.

If the plating liquid cannot flow through the second electrode, the plating liquid introduced from the plating liquid inlet port will flow upward through a space defined between the second electrode and the plating vessel. In this case, the plating liquid unevenly flows in the plating vessel, providing an uneven electric current density distribution.

According to the present arrangement, however, the plating liquid introduced from the plating liquid inlet port is diffused toward the entire lower surface of the mesh-shaped second electrode by the plating liquid diffusing member. The plating liquid further flows through the mesh-shaped second electrode and then flows upward through the through-holes of the electric current limiting member. Thus, substantially uniform upward flow of the plating liquid can be provided in the entire plating vessel. Therefore, the electric current generally evenly flows through the plating liquid.

The plating liquid diffusing member may be a shower nozzle comprising a hollow semispherical member formed with a multiplicity of holes.

The plating method according to the present invention is adapted to perform a plating process for plating a surface of the substrate. This method comprises: the step of bringing a first electrode into contact with a peripheral edge portion of the substrate; the substrate contacting step of bringing the surface of the substrate into contact with a plating liquid with the substrate kept in contact with the first electrode, the plating liquid being contained in a plating vessel having a generally vertical tubular interior surface, and having a second electrode and an electric current limiting member disposed therein; the plating step of plating the surface of the substrate kept in contact with the plating liquid by applying a DC voltage between the first electrode and the second electrode with the substrate kept in contact with the plating liquid and with the substrate being spaced from the second electrode by a distance which is not smaller than a distance between a center portion and a peripheral edge portion of the substrate; and the step of limiting horizontal flow of an electric current in the plating liquid between the second electrode and the substrate within the plating vessel by the electric current limiting member during the plating step.

The method can provide a film having a highly uniform thickness by the plating.

The substrate contacting step may comprise the step of bringing the substrate into contact with the plating liquid contained in the plating vessel in the vicinity of an upper edge of the tubular interior surface of the plating vessel.

The electric current limiting member may have through-holes horizontally densely formed therein and each extending vertically. In this case, the plating step may be performed with upper ends of the through-holes being located in the vicinity of the substrate and with lower ends of the through-holes being located in the vicinity of the second electrode.

The substrate may have a generally round shape, and the tubular interior surface may be a cylindrical interior surface having an inner diameter which is nearly equal to the diameter of the generally round substrate. In this case, the plating step may further comprise the step of rotating the substrate. Thus, the uniformity of the thickness of the film formed by the plating can further be improved.

The foregoing and other objects, features and effects of the present invention will become more apparent from the following description of the preferred embodiments with reference to the attached drawings.

DESCRIPTION OF THE PREFERRED EMBODIMENTS

Figure 1:
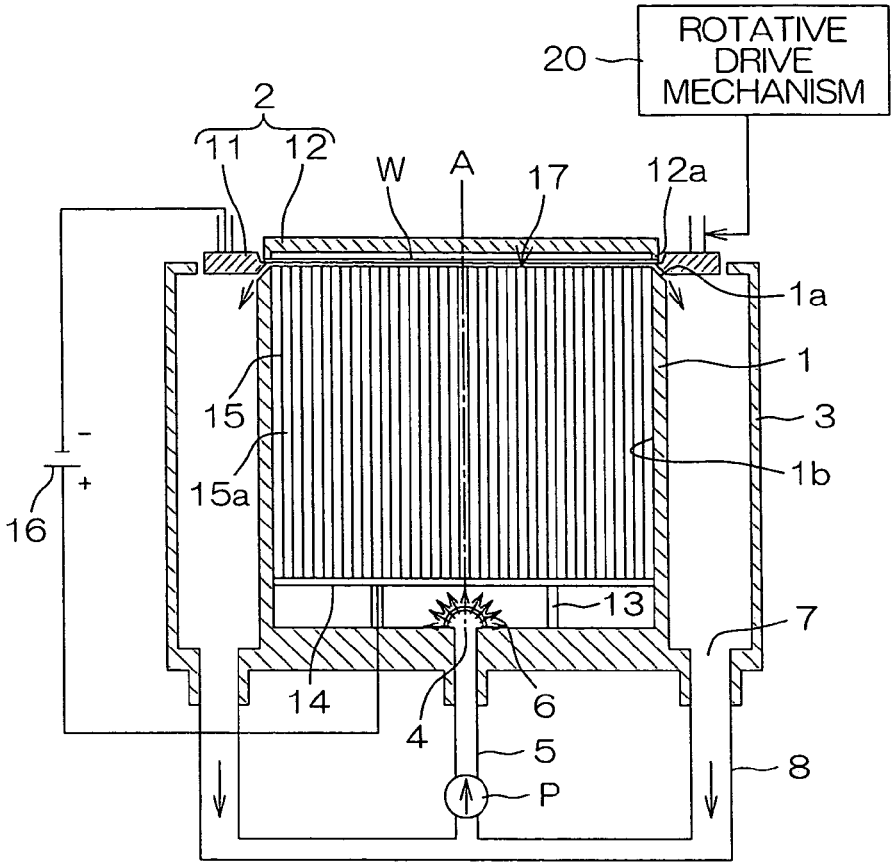
FIG. 1 is a schematic sectional view illustrating the construction of a plating apparatus according to one embodiment of the present invention.

FIG. 1 is a schematic sectional view illustrating the construction of a plating apparatus according to one embodiment of the present invention.

The plating apparatus is adapted to perform a plating process for copper-plating one surface of a semiconductor substrate W as a generally round substrate (hereinafter referred to as "wafer"), and includes a plating vessel 1 for containing a plating liquid, and a holder 2 for generally horizontally holding the wafer W above the plating vessel 1.

The holder 2 includes a cathode ring 11 having a ring-shape as seen in plan and including a plurality of cathodes (not shown), and a disk-shaped press member 12. The cathode ring 11 has an inner diameter slightly smaller than the diameter of the wafer W. The press member 12 has substantially the same diameter as the wafer W, and includes an annular projection 12*a* provided circumferentially of the press member 12 on one surface of the press member 12 (in opposed relation to the wafer. W). The wafer W can horizontally be held with a peripheral edge portion of a lower surface thereof being supported by the cathode ring 11 and with a peripheral edge portion of an upper surface thereof being pressed by the annular projection 12*a*. At this time, the cathodes of the cathode ring 11 are brought into contact with the lower surface of the wafer W at circumferentially equidistantly spaced positions.

A lift mechanism not shown is coupled to the holder 2, so that the wafer W held by the holder 2 can be moved up and down to bring the lower surface of the wafer W into and out of contact with the surface of the plating liquid filled in the plating vessel 1. A rotative drive mechanism 20 is coupled to the holder 2, so that the wafer W generally horizontally held by the holder 2 can be rotated about the center thereof within a generally horizontal plane. The rotation of the wafer W ensures uniform plating.

A plating liquid inlet port 4 for introducing the plating liquid into the plating vessel 1 is provided in a center portion of the bottom of the plating vessel 1, and a plating liquid inlet pipe 5 is connected to the plating liquid inlet port 4 in communication with the plating vessel 1. A semispherical shower nozzle 6 formed with a multiplicity of holes is attached to the plating liquid inlet port 4.

A recovery vessel 3 for recovering the plating liquid overflowing from the plating vessel 1 is provided around the plating vessel 1. A plating liquid outlet port 7 for discharging the plating liquid from the recovery vessel 3 is provided in the bottom of the recovery vessel 3. A plating liquid outlet pipe 8 is connected to the plating liquid outlet port 7 in communication with the recovery vessel 3. The plating liquid inlet pipe 5 and the plating liquid outlet pipe 8 are connected to each other via a pump P, so that the plating liquid discharged from the plating liquid recovery vessel 3 can be fed back into the plating vessel 1.

Figure 2:
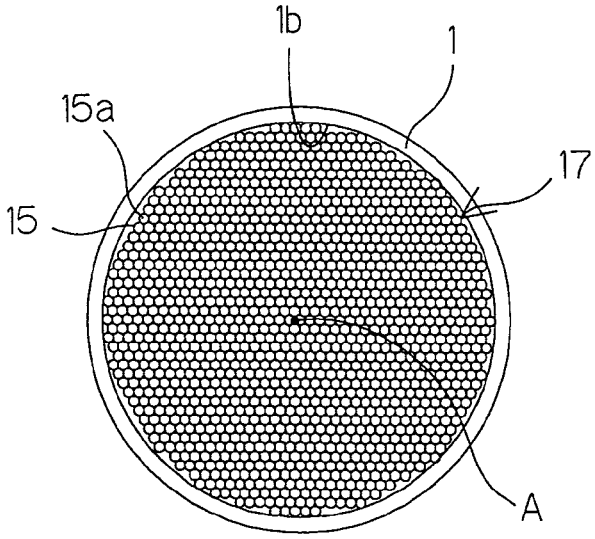
FIG. 2 is a schematic plan view of a plating vessel.

FIG. 2 is a schematic plan view of a plating vessel 1.

Referring to FIGS. 1 and 2, the plating vessel 1 has a cylindrical interior surface 1*b* and a center axis A extending vertically. The inner diameter of the plating vessel 1 is nearly equal to the diameter of the wafer W. The plating vessel 1 has a thin wall portion 1*a* formed by outwardly diagonally cut away an upper portion of a sidewall thereof. Thus, interference between the plating vessel 1 and the cathode ring 11 is prevented when the lower surface of the wafer W is brought into close proximity to the surface of the plating liquid.

An anode 14 is attached to the bottom of the plating vessel 1 via support members 13. The anode 14 is, for example, a mesh member such as prepared by coating a titanium wire material with iridium oxide by flame spraying. The anode 14 has a disk external shape and a diameter nearly equal to the inner diameter of the plating vessel 1, and is horizontally supported. The anode 14 is generally centered on the center axis A. The support members 13 each have a height which is about one eighth to about one ninth the depth of the plating vessel 1, so that the anode 14 is located at a depth about one eighth to about one ninth the depth of the plating vessel 1 from the bottom of the plating vessel 1.

A distance between the wafer W and an upper surface of the anode 14 is greater than a distance between the center and the peripheral edge of the wafer W, i.e., a distance between the center of the wafer W and the cathode ring 11. Therefore, the plating liquid has a sufficiently high resistance as measured vertically.

A plurality of resin tubes 15 each extending vertically are horizontally densely arranged above the anode 14 in the plating vessel 1. These resin tubes 15 constitute a honeycomb-like electric current limiting member 17. The resin tubes 15 each have a small wall thickness and a generally round outer shape in section. The resin tubes 15 each have a sufficiently small inner diameter as compared with the inner diameter of the plating vessel 1, and a cross sectional area of not greater than 10 $cm^2$, for example.

One example of the resin tube 15 is a commercially available drinking straw. The resin tubes 15 each have a length such that the upper ends thereof are located at substantially the same level as the upper edge of the plating vessel 1. For prevention of the upward movement of the resin tubes 15 due to the flow of the plating liquid, a thin fluororesin mesh (not shown) is provided on the electric current limiting member 17. More specifically, the upper ends of the resin tubes 15 are located at a slightly lower position than the upper edge of the plating vessel 1. Therefore, the mesh is prevented from projecting out of the surface of the plating liquid, when the plating liquid overflows from the plating vessel 1.

The cathodes of the cathode ring 11 and the anode 14 are connected to a DC power source 16. A copper seed layer is provided on the one surface of the wafer W for facilitating the deposition of copper atoms by the plating.

When the wafer W is to be plated with copper, the plating liquid is first introduced into the plating vessel 1 from the plating liquid inlet port 4 by the pump P. The plating liquid is supplied upwardly and laterally in various directions into the plating vessel 1 from the shower nozzle 6. Then, the plating liquid flows through the mesh anode 14 and further flows upward through through-holes of the electric current limiting member 17 (mainly through through-holes 15*a* of the resin tubes 15). This provides generally uniform upward flow of the plating liquid throughout the plating vessel 1. The anode 14 of the titanium material coated with iridium oxide by flame spraying is insoluble in the plating liquid.

The plating liquid reaching the upper edge of the plating vessel 1 overflows from the upper edge of the side wall of the plating vessel 1 into the recovery vessel 3, and is discharged from the plating liquid outlet port 7. Then, the discharged plating liquid flows through the plating liquid outlet pipe 8, the pump P and the plating liquid inlet pipe 5, and is introduced again into the plating vessel 1 from the plating liquid inlet port 4.

Subsequently, the wafer W is generally horizontally held by the holder 2 with the seed layer surface thereof facing downward. Thus, the cathodes of the cathode ring 11 are brought into contact with the lower surface of the wafer W at the circumferentially equidistantly spaced positions. Then, the lower surface of the wafer W is brought into contact with the surface of the plating liquid filled in the plating vessel 1 by the lift mechanism not shown, and rotated by the rotative drive mechanism 20. In this state, the electric current limiting member 17 intervenes between the anode 14 and the wafer W.

Thereafter, a DC voltage is applied between the anode 14 and the cathodes of the cathode ring 11 by the DC power source 16. Thus, electrons are donated to copper ions in the plating liquid from the lower surface of the wafer W, whereby copper atoms are deposited on the lower surface of the wafer W. Thus, the lower surface of the wafer W is electrolytically plated.

Figure 3:
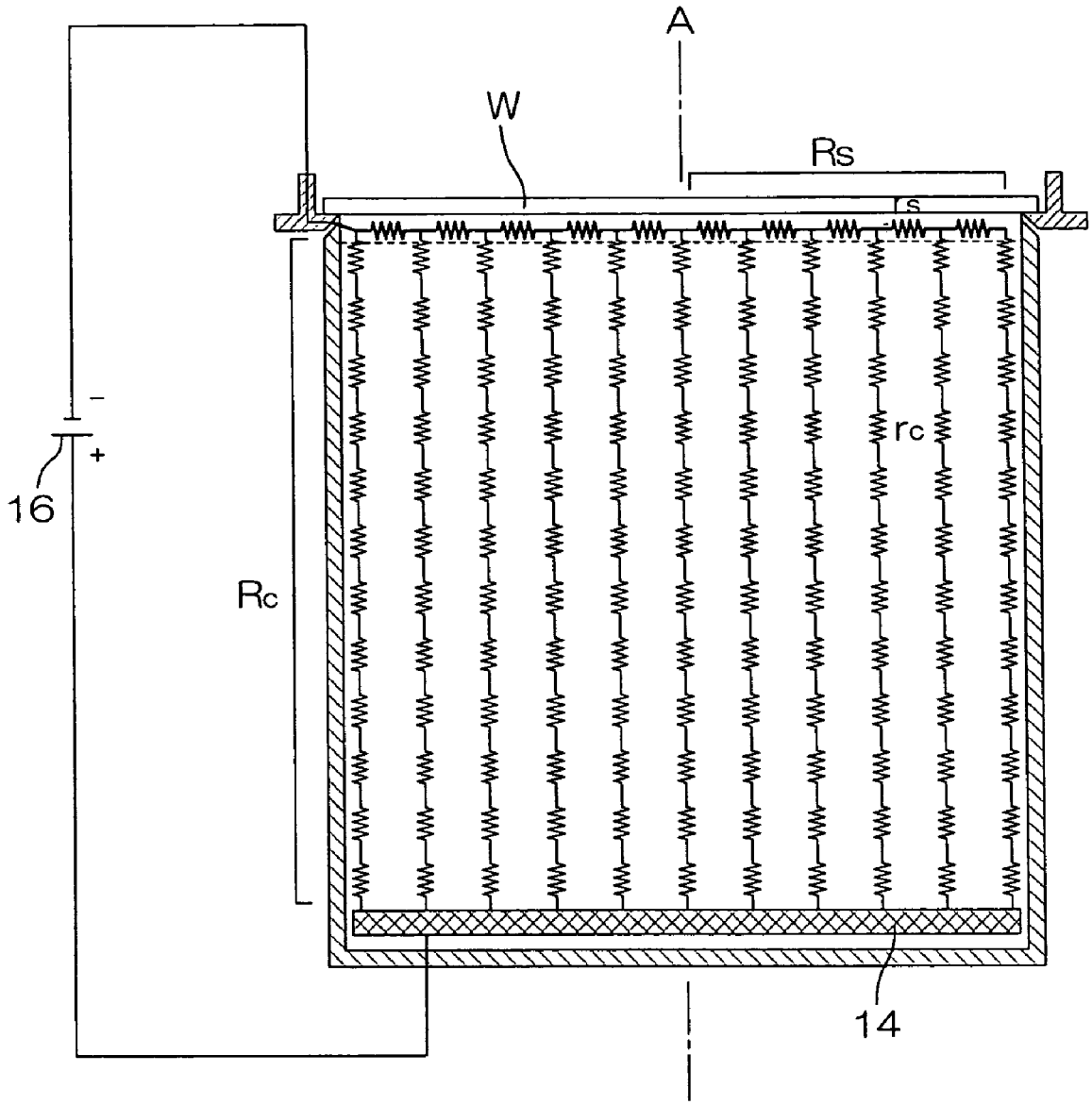
FIG. 3 is a diagram illustrating an electrical equivalent circuit assumed to be present when a plating process is performed by the plating apparatus of FIG. 1.
Figure 4:
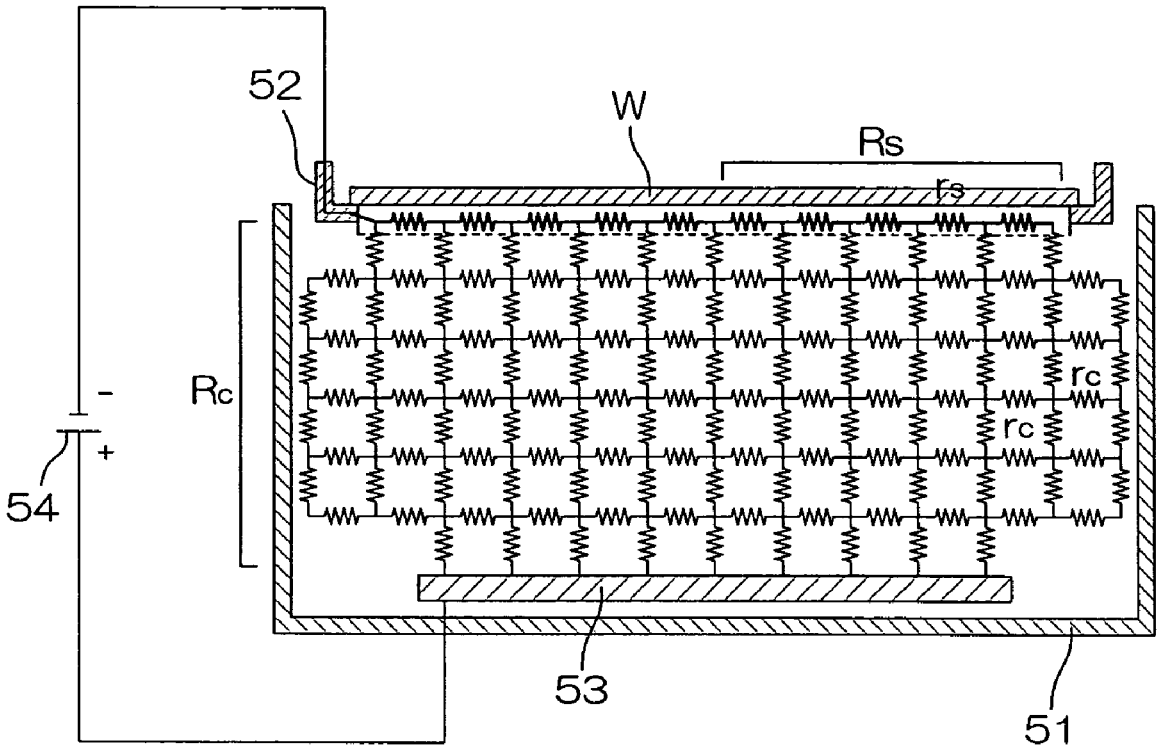
FIG. 4 PRIOR ART
FIG. 4 is a schematic sectional view of a conventional plating apparatus illustrating an electrical equivalent circuit.

FIG. 3 is a diagram illustrating an electrical equivalent circuit assumed to be present when the plating process is performed by the plating apparatus of FIG. 1.

The electric current cannot flow laterally across the insulative resin tubes 15 of the electric current limiting member 17 in the plating liquid, but can flow laterally only within the through-hole 15*a* of each of the resin tubes 15. Since the inner diameter of the resin tube 15 is much smaller than the inner diameter of the plating vessel 1, the electric current practically flows only vertically in the electric current limiting member 17.

Further, the electric current limiting member 17 intervenes between the anode 14 and the wafer W to occupy most of a space vertically defined therebetween, so that the electric current can laterally flow virtually nowhere in the plating liquid.

Therefore, the plating liquid is regarded as being constituted by a plurality of resistance lines which are each connected between the anode 14 and the seed layer formed on the lower surface of the wafer W and each include a plurality of resistance components each having a resistance rc and vertically connected to one another in series. Further, the seed layer formed on the lower surface of the wafer W is regarded as being constituted by a plurality of resistance components each having a resistance rs and connected to one another in series between the center and the peripheral edge portion of the wafer W.

A comparison is herein made between the resistance of an electric current path (hereinafter referred to as "first path") extending from the center portion of the anode 14 vertically through the plating liquid to the center portion of the lower surface of the wafer W and then to the cathodes kept in contact with the peripheral edge portion of the wafer W and the resistance of an electric current path (hereinafter referred to as "second path") extending from the peripheral edge portion of the anode 14 vertically through the plating liquid to the peripheral edge portion of the wafer W and then to the cathodes kept in contact with the peripheral edge portion of the wafer W. It is herein assumed that the plating liquid has a resistance Rc as measured vertically and the seed layer has a resistance Rs as measured between the center portion and the peripheral edge portion of the wafer W.

In this case, the resistance of the first path is Rc+Rs, and the resistance of the second path is nearly equal to Rc.

The seed layer has a small thickness and, hence, has a high resistance. Particularly, where a minute pattern is to be formed on the wafer W, the seed layer has a very small thickness (e.g., 50 to 100 nm). Further, via-holes are often formed in the surface of the wafer W before the formation of the seed layer. Where the pattern is minute in this case, the via-holes each have a small diameter. If the seed layer is formed as having a great thickness, the via-holes may be closed with the seed layer. For this reason, the thickness of the seed layer is reduced, so that the resistances rs and Rs are increased.

Even in such a case, if the plating vessel 1 has a sufficiently great depth (the distance between the anode 14 and the wafer W is great), the resistance Rc is sufficiently greater than the resistance Rs, so that a resistance ratio Rc/Rc+Rs is reduced.

Further, the electric current flowing from the center portion of the anode 14 (present on the center axis A) to the plating liquid is forcibly directed upward along the center axis A by the electric current limiting member 17 to reach the center portion of the wafer W.

Since the inner diameter of the plating vessel 1 is nearly equal to the diameter of the wafer W, the upper edge of the cylindrical interior surface 1*b* of the plating vessel 1 can be brought into close proximity to the entire peripheral edge portion of the wafer W. That is, the wafer W can be located in virtually overlapped relation with the plating liquid as seen in plan. When the plating process is performed in this state, the electric current cannot flow outwardly of the peripheral edge portion of the wafer W as seen in plan. Therefore, the amount of the electric current flowing through the first path is nearly equal to the amount of the electric current flowing through the second path with no possibility that an increased amount of the electric current flows in the vicinity of the cylindrical interior surface 1*b* of the plating vessel 1.

Since the growth rate and thickness (plating thickness) of the copper film formed by the plating are proportional to the amount of the electric current flowing between the plating liquid and the lower surface (seed layer) of the wafer W, the copper film uniformly grows on the lower surface of the wafer W at a generally constant rate. Thus, the reduction of the difference between Rc and Rc+Rs by the increase in the depth of the plating vessel 1 directly contributes to the uniformity of the plating thickness, unlike the conventional plating apparatus.

As the copper film grows (as the film thickness is increased), the resistance of the copper film is drastically reduced to a negligible level as compared with the resistance Rc of the plating liquid as measured vertically. Thus, the resistance difference between the first and second paths extending from the anode 14 and the cathodes is further reduced, so that the uniformity of the plating thickness is further improved.

For example, it is herein assumed that the depth of the plating vessel is 100 mm, the resistivity of the plating liquid is 2 Ωcm, the diameter of the wafer W is 200 mm, and the thickness of the copper seed layer is 100 nm. Then, the ratio of Rs and Rc is Rs:Rc≈1:10. In this case, the ratio of Rc and Rc+Rs is Rc:Rc+Rs=10:11, so that the growth rate of the copper film formed by the plating is about 10% lower in the center portion of the wafer W than in the peripheral edge portion of the wafer W.

However, when the thickness of the copper film (including the thickness of the seed layer (this definition is effective in the following description)) reaches 200 nm, the difference in the copper film growth rate between the center portion and the peripheral edge portion of the wafer W is reduced to 5%. When the thickness of the copper film reaches 400 nm, the difference in the copper film growth rate is further reduced to 2.5%. When the thickness of the copper film reaches about 1 μm which is ten times the thickness of the seed layer, the uniformity of the thickness of the copper film (the ratio of the film thickness in the center portion of the wafer to the film thickness in the peripheral edge portion of the wafer) is 97% or higher.

Since the electric current limiting member 17 is composed of an insulative material, the amount of the electric current flowing above non-opening portions of the electric current limiting member 17 between the electric current limiting member 17 and the wafer W is reduced. However, the resin tubes 15 each have a small wall thickness, so that the non-opening portions of the electric current limiting member 17 account for a small percentage (the opening ratio is high). Therefore, the electric current generally evenly flows between the plating liquid and the lower surface of the wafer W, so that the plating thickness is generally uniform everywhere on the lower surface of the wafer W.

The amount of the electric current flowing through each of the electric current paths between the anode 14 and the cathodes (electric current density distribution) depends on the flow of the plating liquid as well as on the resistance distribution between the anode 14 and the cathodes.

In this embodiment, the plating liquid flows in the form of a generally uniform upward flow throughout the plating vessel 1. Therefore, the electric current generally uniformly flows in the plating liquid to provide a uniform plating thickness.

The electric current limiting member 17 can easily be prepared by packing the plurality of resin tubes 15 in the plating vessel 1. That is, there is no need to fix the resin tubes 15 to the interior surface 1*b* of the plating vessel 1 and to fix the resin tubes 15 to each other with the use of an adhesive. Since commercially available drinking straws can be employed as the material for the electric current limiting member 17, the electric current limiting member 17 can be prepared at a very low cost.

The present invention is not limited to the embodiment described above. For example, the resin tubes 15 may have a polygonal cross section such as a tetragonal or hexagonal cross section rather than a round cross section. Tubes of an insulative ceramic material may be employed instead of the resin tubes 15.

Further, a plurality of plating liquid inlet ports 4 may be provided in the bottom of the plating vessel 1. In this case, the uniformity of the upward flow of the plating liquid in the plating vessel 1 can be improved.

The electric current limiting member 17 may comprise a plurality of pipes having different diameters and arranged coaxially. Since the unevenness of the electric current density distribution in the plating liquid is observed radially of the wafer W between the center portion and the peripheral edge portion of the wafer W, the coaxially arranged pipes also alleviate the unevenness of the electric current density distribution.

Where the inner diameter of the plating vessel 1 is greater than the diameter of the wafer W, the uneven electric current flow in the plating vessel 1 can be suppressed by providing the electric current limiting member 17 closely in the plating vessel 1.

The substrate may be a rectangular substrate rather than the wafer W. In this case, the interior surface 1*b* of the plating vessel 1 is dimensioned and configured substantially conformally to the substrate as seen in plan.

While the present invention has been described in detail by way of the embodiment thereof, it should be understood that the foregoing disclosure is merely illustrative of the technical principles of the present invention but not limitative of the same. The spirit and scope of the present invention are to be limited only by the appended claims.

This application corresponds to Japanese Patent application No. 2002-251311 filed with the Japanese Patent Office on Aug. 29, 2002, the disclosure of which is incorporated herein by reference.

What is claimed is:

1. A plating apparatus for performing a plating process for plating a surface of a substrate, the plating apparatus comprising:

a first electrode to be brought into contact with a peripheral edge portion of the substrate;

a plating vessel for containing a plating liquid to be brought into contact with the surface of the substrate, the plating vessel having a vertical tubular interior surface;

a second electrode disposed in the plating vessel, the second electrode being spaced from the substrate by a distance which is not smaller than half of the inner diameter of the plating vessel; and an electric current limiting member for limiting horizontal flow of an electric current in the plating liquid between the second electrode and the substrate within the plating vessel during the plating process;

wherein the electric current limiting member has through-holes disposed across the horizontal cross-section thereof and each extending vertically;

wherein said through-holes of the electric current limiting member are provided by a plurality of tubes vertically disposed side-by-side and in contact with each other, occupying a space defined between the second electrode and the substrate in the plating vessel during the plating process; and wherein an inner space and an outer lateral space of each tube communicate with each other via a space within the plating vessel below the plurality of tubes.

2. A plating apparatus as set forth in claim 1, wherein the tubular interior surface of the plating vessel has an upper edge configured so as to permit the substrate to contact the plating liquid contained in the plating vessel in the vicinity of the upper edge of the tubular interior surface of the plating vessel during the plating process.

3. A plating apparatus as set forth in claim 1, wherein the plurality of tubes are composed of an insulative material.

4. A plating apparatus as set forth in claim 1, wherein through-holes of the tubes each have a cross sectional area of not greater than 10 $cm^2$.

5. A plating apparatus as set forth in claim 1, wherein lower ends of through-holes of the tubes are located at the second electrode.

6. A plating apparatus as set forth in claim 1, wherein the substrate has a generally round shape, the apparatus further comprising a substrate rotating mechanism for horizontally holding and rotating the generally round substrate, wherein the tubular interior surface is a cylindrical interior surface having an inner diameter which is nearly equal to the diameter of the generally round substrate.

7. A plating apparatus as set forth in claim 1, wherein the second electrode has an area substantially the same as an area of the electric current limiting member and is disposed so as to substantially overlaps the electric current limiting member when the plating vessel is viewed vertically.

8. A plating apparatus as set forth in claim 1, wherein the first electrode is a cathode, wherein the second electrode is an insoluble mesh anode which permits the plating liquid to flow therethrough, wherein the plating vessel has a plating liquid inlet port provided in the bottom thereof for introducing the plating liquid into the plating vessel, the apparatus further comprising a plating liquid diffusing member for diffusing the plating liquid introduced from the plating liquid inlet port toward the entire lower surface of the second electrode.

9. A plating apparatus as set forth in claim 1, wherein the plurality of tubes are composed of resin.

* * * * *